US010086982B2

(12) United States Patent
Bristow

(10) Patent No.: US 10,086,982 B2
(45) Date of Patent: Oct. 2, 2018

(54) CLOSURE ASSEMBLY FOR A CONTAINER AND A CONTAINER COMPRISING THE SAME

(71) Applicant: ROTAM AGROCHEM INTERNATIONAL COMPANY LIMITED, Chai Wan (HK)

(72) Inventor: James Timothy Bristow, Chai Wan (HK)

(73) Assignee: ROTAM AGROCHEM INTERNATIONAL COMPANY LIMITED, Chai Wan (HK)

( * ) Notice: Subject to any disclaimer, the term of this patent is extended or adjusted under 35 U.S.C. 154(b) by 191 days.

(21) Appl. No.: 15/030,822

(22) PCT Filed: Oct. 13, 2014

(86) PCT No.: PCT/CN2014/088454

§ 371 (c)(1),
(2) Date: Apr. 20, 2016

(87) PCT Pub. No.: WO2015/058629

PCT Pub. Date: Apr. 30, 2015

(65) Prior Publication Data

US 2016/0264314 A1 Sep. 15, 2016

(30) Foreign Application Priority Data

Oct. 24, 2013 (GB) ..... 1318808.1

(51) Int. Cl.
*B65D 47/06* (2006.01)
*B65D 47/28* (2006.01)
(Continued)

(52) U.S. Cl.
CPC ..... *B65D 47/06* (2013.01); *B65D 43/0225* (2013.01); *B65D 43/20* (2013.01);
(Continued)

(58) Field of Classification Search
CPC ..... B65D 47/06; B65D 51/18; B65D 43/20; B65D 43/22; B65D 43/0225;
(Continued)

(56) References Cited

U.S. PATENT DOCUMENTS 3,409,189 A * 11/1968 McKeand, Jr. ..... B65D 47/286 222/561
3,731,855 A * 5/1973 Vos ..... B65D 83/207 222/394
(Continued)

FOREIGN PATENT DOCUMENTS

CN 1213913 C 8/2005
CN 202013218 U 10/2011
(Continued)

OTHER PUBLICATIONS

International Search Report and Written Report dated Jan. 28, 2015.

*Primary Examiner* — James N Smalley
(74) *Attorney, Agent, or Firm* — Dickinson Wright PLLC

(57) ABSTRACT

A closure assembly for a container is provided, the closure assembly comprising: a closure body for securing to the container to extend across and seal an opening in the container; the closure body comprising a bore therein, the bore communicating with the opening in the container and providing a conduit between the interior of the container and the exterior of the container through which product within the container may be dispensed; a closure member having a port therein, the closure member slideably mounted to the closure body and slideable between a closed position in which the port is out of alignment with the bore in the closure body and the closure member acts to close the bore in the closure member and an open position in which the port is aligned with the bore in the closure body. A measuring vessel for use with the closure assembly is also provided.

44 Claims, 10 Drawing Sheets

(51) Int. Cl.

| | |
|---|---|
| ***B65D 43/02*** | (2006.01) |
| ***B65D 43/20*** | (2006.01) |
| ***B65D 43/22*** | (2006.01) |
| ***B65D 51/18*** | (2006.01) |

(52) U.S. Cl.
CPC ..... *B65D 43/22* (2013.01); *B65D 47/286* (2013.01); *B65D 51/18* (2013.01); *B65D 2251/009* (2013.01); *B65D 2251/0018* (2013.01); *B65D 2251/0028* (2013.01); *B65D 2251/0081* (2013.01); *B65D 2543/00055* (2013.01)

(58) Field of Classification Search
CPC ..... B65D 47/286; B65D 2251/009; B65D 2251/0018; B65D 2251/0028; B65D 2251/0081; B65D 2543/00055
USPC ..... 220/254.9, 348; 222/561
See application file for complete search history.

(56) References Cited

U.S. PATENT DOCUMENTS

| | | | | |
|---|---|---|---|---|
| 4,637,531 | A * | 1/1987 | Olsson | B05C 17/00516 222/327 |
| 5,620,114 | A | 4/1997 | Chalfa, Jr. | |
| 2008/0257884 | A1 | 10/2008 | Geberzahn et al. | |

FOREIGN PATENT DOCUMENTS

| | | | |
|---|---|---|---|
| CN | 102281957 | A | 12/2011 |
| GB | 2217695 | A | 11/1989 |
| WO | 03101842 | A1 | 12/2003 |

* cited by examiner

CLOSURE ASSEMBLY FOR A CONTAINER AND A CONTAINER COMPRISING THE SAME

This application is a 371 national phase entry of PCT/CN2014/088454, filed 13 Oct. 2014, which claims benefit of GB Patent Application No. 1318808.1, filed 24 Oct. 2013, the entire contents of which are incorporated herein by reference for all purposes.

FIELD

The present invention relates to a closure assembly for a container and to a container comprising the closure assembly. The closure assembly is advantageous for use dispensing compositions from a container in measured amounts, for example compositions in powder or granule form. One application for the closure assembly is in the field of agrochemicals, in particular for use with containers holding an agrochemical product.

BACKGROUND

Many products are provided within containers, in which the product is held while in storage and transit and from which the product is dispensed by the user. Such containers are frequently formed from plastic, although other materials may be used to from part or all of the container, such as glass or metal.

One example of a range of products for which such containers are used is in the agrochemical field. Agrochemical products, such as pesticides, including herbicides, insecticides, fungicides, acaricides and the like, are formulated in a range of different ways. Such formulations include liquid-based formulations, such as solutions, emulsions and suspensions, powder formulations and granule formulations.

In many cases, products, such as aforementioned agrochemical products, are required to be dispensed from the container in measured quantities or doses by the user. The amount to be dispensed will depend upon the product and the use to which it is being put by the user. For example, many of the aforementioned agrochemical products are prepared and provided in a concentrate form. The end user is required to dilute or disperse the product in a suitable carrier, for example water, before application to the locus to be treated. The product is generally applied to a locus at a specific rate of application. This in turn requires the user to carefully meter the amount of product dispensed from the container for use.

There is a need for an improved closure assembly for a container, which allows a product to be dispensed from the container in a safe and controlled manner. It would be advantageous if the closure assembly allowed the user to dispense the product in a measured amount, more preferably allowing the user to have precise control over the amount of product dispensed from the container.

SUMMARY

According to a first aspect of the present invention, there is provided a closure assembly for a container, the closure assembly comprising:

a closure body for securing to the container to extend across and seal an opening in the container;

the closure body comprising a bore therein, the bore communicating with the opening in the container and providing a conduit between the interior of the container and the exterior of the container through which product within the container may be dispensed;

a closure member having a port therein, the closure member slideably mounted to the closure body and slideable between a closed position in which the port is out of alignment with the bore in the closure body and the closure member acts to close the bore in the closure member and an open position in which the port is aligned with the bore in the closure body.

According to another aspect of the invention, the closure assembly is for use with a container. The container may be any that is suitable for holding the product. The precise form of the container will be determined by such factors as the nature and composition of the product to be held and the use to which the container is put. The container has a bore therein, through which product is provided to the container and more particularly, is dispensed from the interior of the container. The container may be formed from any suitable material, with plastic being a common material of construction. Suitable containers are known in the art and are commercially available. It is an advantage of the closure assembly that it may be arranged for use in conjunction with known designs of container and does not require a specific form or arrangement of container to be provided.

The closure assembly comprises a closure body. The closure body may have any suitable form. In one embodiment, the closure body is generally cylindrical. However, other shapes may be employed, as desired or required. For example, the closure body may have a form that matches that of the exterior of the container.

The closure body is provided with a bore therethrough. When the closure body is in use and secured to a container, the bore provides a conduit communicating the interior of the container with the exterior. When the bore is open, product may be dispensed through the bore from within the container. The bore may have any suitable form. In one embodiment, the bore is generally circular in cross-section. However, the bore may have other shapes in cross-section, for example rectangular or tear-shaped. The cross-sectional area of the bore may be constant along the length of the bore. In one preferred embodiment, the bore is tapered, more preferably with the wider portion of the bore being disposed on the side of the closure body that is towards the interior of the container, when the assembly is in use. The taper in the bore assists in product moving through the bore, in particular when the product is a solid product, such as granules or a powder.

The bore may be located at any location in the closure body. In a preferred embodiment, the bore is located centrally in the closure body, more preferably having its longitudinal axis aligned with the longitudinal axis of the closure body.

In one preferred embodiment, the closure body comprises a closure portion for extending across the opening in the container and having the bore therethrough. The closure portion is preferably a generally flat or planar body, having opposing major faces, one of which is an interior face and the other is an exterior face, when the closure assembly is in position on a container. In many embodiments the closure portion is circular in shape, that is a disc. The closure portion may be of other shapes.

The closure body is for securing to the container so as to extend across and seal the opening in the container. The closure body may secure to the container in any suitable manner. In one preferred embodiment, the closure assembly is provided with a threaded portion for engaging with a complimentary thread on the container. The threaded portion of the closure body may have the thread formed on an interior or exterior portion, so as to engage with a complimentary exterior or interior thread on the container. Such fastening arrangements for closure assemblies are known in the art. Alternatively, the closure assembly may be secured to the container in another manner, for example by way of a suitable clamping means comprising one or more clamps, or other locking means. Again, such fastening arrangements are known in the art.

In a preferred embodiment, the closure body comprises a mounting portion having a thread thereon for engaging with a complimentary thread on the container, in particular in the region of the opening of the container. In a preferred embodiment, the mounting portion comprises an internal thread formed thereon for engaging with an external thread on the container in the region of the opening of the container. The mounting portion is preferably generally tubular, with a generally cylindrical mounting portion being particularly preferred. Preferably, the mounting portion of the closure body is arranged to extend around, so as to receive therein, a neck portion of the container, the neck portion being provided with the opening therein and the external thread thereon. Alternatively, the mounting portion may be provided with an external thread, the mounting portion being arranged to extend into the opening of the container and engage with an internal thread thereon.

In embodiments in which the closure body comprises a closure portion as described hereinbefore, the mounting portion preferably extends from one side of the closure portion, more preferably generally perpendicular to the closure portion, such that the closure portion extends laterally across and closes one end of the mounting portion.

The closure body may comprise first means to engage with the container holding the product to be dispensed, such as a first mounting portion for engaging with the container in the region of the opening, as noted above, and second means for engaging with a second container, in particular a measuring vessel, described in more detail hereinafter. The closure body may secure to the second container in any suitable manner. In one preferred embodiment, the closure assembly is provided with a threaded portion for engaging with a complimentary thread on the second container. The threaded portion of the closure body may have the thread formed on an interior or exterior portion, so as to engage with a complimentary exterior or interior thread on the second container. Such fastening arrangements for closure assemblies are known in the art. Alternatively, the closure assembly may be secured to the second container in another manner, for example by way of a suitable clamping means comprising one or more clamps, or other locking means. Again, such fastening arrangements are known in the art.

In a preferred embodiment, the closure body comprises a second mounting portion having a thread thereon for engaging with a complimentary thread on the second container, in particular in the region of the opening of the second container. In a preferred embodiment, the second mounting portion comprises an external thread formed thereon for engaging with an internal thread on the second container in the region of the opening of the container. The second mounting portion is preferably generally tubular, with a generally cylindrical second mounting portion being particularly preferred. Preferably, the second mounting portion of the closure body is arranged to extend into, so as to be received in, the portion of the second container containing the opening, the second container being provided with an internal thread thereon. Alternatively, the second mounting portion may be provided with an internal thread, the second mounting portion being arranged to extend around the opening of the second container and engage with an external thread thereon.

In embodiments in which the closure body comprises a closure portion as described hereinbefore, the second mounting portion preferably extends from one side of the closure portion, more preferably generally perpendicular to the closure portion, such that the closure portion extends laterally across and closes one end of the second mounting portion.

In a particularly preferred embodiment, the closure body comprises a generally planar closure portion for extending across the opening in the container and having the bore therethrough, a generally tubular first mounting portion extending from one side of the closure portion for engaging with the container in the region of the opening therein, and a generally tubular second mounting portion extending from the second side of the closure portion, opposite the first side, for engaging with the second container in the region of the opening therein. Most preferably, the first and second mounting portions are aligned such that their longitudinal axes coincide. It is particularly preferred that the bore in the closure body is centrally located about these coincident axes.

The closure body is preferably formed as a single piece, for example by moulding. The closure body may be formed from any suitable material. The material should be selected to be compatible with and resistant from degradation by the products contained in and to be dispensed from the container. Suitable materials for the closure body include a wide range of plastics, in particular polyolefins, with polypropylene being particularly preferred.

In use the closure body extends across and closes the opening in the container. The closure body provides a seal with the container. The seal formed between the closure body and the container should at least prevent product from leaving the container. In one preferred embodiment, the seal is fluid tight, most preferably gas tight. Suitable means for forming a seal are known in the art. For example, the seal may be formed directly between the closure body and the container. Alternatively, a seal member may be provided, to be disposed between the closure body and the container when the closure assembly is in place on the container and secured.

Suitable materials for forming the seal are known in the art. The material of the seal should be compatible with and resist degradation by the contents of the container.

The closure assembly further comprises a closure member. The closure member has a port therein. The closure member is moveable with respect to the closure body between a closed position and an open position. In the closed position, the port in the closure member is not aligned with the bore in the closure body and the closure member acts to close and seal the bore in the closure body. In the open position, the port in the closure member is aligned with the bore in the closure body, such that the port and the bore form a conduit through which product may pass from the interior of the container and be dispensed by the user.

The closure member is slideable with respect to the closure body. In this respect, the sliding motion of the closure member with respect to the closure body is to be contrasted with the rotary motion of some known closure assemblies. In particular, the closure member is moveable in a linear path between the open position and the closed position. Preferably, the closure member slides laterally across the closure body, in particular perpendicular to the longitudinal axis of the closure body.

The closure member is preferably disposed at and arranged to move across one end of the bore in the closure body. In this way, the closure member moves across a surface of the closure body. Most preferably, the closure member is disposed on the exterior end of the bore of the closure body, that is the end of the bore that is outside the interior of the container when closed by the closure body. In this way, the closure member moves across an outer surface of the closure body, when the closure assembly is in position on a container. In this way, the movement of the closure member across the closure body is not impeded or otherwise affected by the contents of the container.

The closure member has a port therein. The port is a bore extending through the closure member. The bore may have any form. Preferably, the port is generally circular in cross-section, at least in part of its length.

The closure member may have any suitable form. In a preferred embodiment, the closure member is in the form of a generally flat or planar body having opposing major faces. The port extends from the first major face to the second major face. In the preferred arrangement noted above, with the closure member disposed at one end of the bore in the closure body, the first major face is adjacent the exterior surface of the closure body, with the second major face facing away from the closure body.

In one embodiment, the port is tapered or flared, preferably such that the cross-sectional area of the port increases as it extends in the direction from the first major face of the planar closure member to the second major face. The opening in the first major face is preferably circular. In one embodiment, the opening in the second major face is generally rectangular. The port may flare from the first major face to the second major face symmetrically about the longitudinal axis of the port. Alternatively, the port may flare asymmetrically about the longitudinal axis of the port.

By having the port flared, such that the port is wider at the second major surface than at the first major surface, with the second major surface being the outer surface of the closure member relative to the interior of the container, the flow of product into the container is assisted, in particular in the case of a solid product in the form of granules or a powder. Therefore, in the event a user dispenses too much product from the container, for example into a measuring vessel, and excess product needs to be returned to the container, the flow of product into the container is assisted by the aforementioned flared arrangement.

The closure member is moved between the open and closed positions by the user when dispensing product from within the container. In one preferred embodiment, the closure member extends through a side wall of the closure body, such that an end portion of the closure member is outside the closure body. In this way, the user may engage with the end portion of the closure member to move it between the open and closed positions. In a preferred arrangement, the outer end portion of the closure member is enlarged, to provide for greater ease of use by the user.

The assembly is preferably provided with a guard member to limit or prevent inadvertent movement of the closure member, in particular to prevent the closure assembly being opened inadvertently. The guard member preferably comprises one or more guard walls extending from the closure body to partially surround the portion of the closure member accessible from outside the closure body. In the preferred embodiment described above, the guard member extends from an outer surface of the closure body and partially surrounds the end portion of the closure member.

The movement of the closure member is preferably limited. In particular, the movement of the closure member from the closed position to the open position is preferably limited to stop the closure member be moved past the open position. The movement of closure member may be limited in this respect by any suitable stop. In one preferred arrangement, the end portion of the closure member extending outside the closure body abuts an outer surface of the closure body when the closure member is in the open position.

In a preferred embodiment, the closure member is biased, most preferably biased into the closed position. The closure member may be biased by a resilient member, such as a spring or other resilient biasing means. In a preferred arrangement, the resilient member comprises a resilient biasing arm. The resilient biasing arm acts between the closure body and the closure member, preferably biasing the closure member into the closed position. The resilient biasing arm is preferably connected to the closure member. In one preferred embodiment, the resilient biasing arm extends from an end portion of the closure member and bears upon an outer surface of the closure body. In preferred form, the resilient biasing arm has a generally V-shape.

In a preferred embodiment, the closure member is moveable between guide members, the action of which is to limit the movement of the closure member to a substantially linear path. Preferably, the guide members are provided on the closure portion, in particular on opposing sides of the opening in the bore in the closure portion.

Preferably, the closure assembly is arranged to prevent the closure member being moved from the closed position into the open position until the closure assembly has been engaged with a vessel, such as a measuring vessel, to receive product dispensed from the container to which the closure assembly is attached. In a preferred arrangement, the closure assembly comprises a retaining member moveable between a locked position, in which movement of the closure member into the open position is prevented, and an unlocked position, in which the closure member may be moved into the open position. The retaining member is preferably biased into the locked position, more preferably with the retaining member being formed of a resilient material. The retaining member is preferably connected to the closure member.

In a further aspect, the present invention provides a container comprising a closure assembly as hereinbefore described.

As mentioned above, the closure assembly is particularly intended for use with containers having contents to be dispensed in measured quantities. It is known to provide measuring vessels, such as measuring cylinders, for determining the quantity of material dispensed from container. As noted above, embodiments of the closure assembly are arranged to engage with a second container, such as a measuring vessel. In this way, a sealed environment may be provided between the container holding the product and the vessel in which the amount dispensed is measured. This in turn prevents spillage of the product and prevents exposure of the user to the product while the measuring step is being carried out. In this respect, product may be dispensed from the container by first securing a measuring vessel to the closure assembly. The closure assembly is then opened, to allow product to be dispensed from the container into the measuring vessel. Once the required amount has been dispensed, the closure assembly is closed. Only then is it necessary to remove the measuring vessel and expose the product to the atmosphere.

Any suitable measuring vessel may be arranged to be engaged by the closure assembly. In one preferred embodiment, the measuring vessel comprises a thread, in particular an internal thread, in the portion adjacent the opening therein, for engaging with the closure assembly. The measuring vessel may be generally cylindrical or frusto-conical. In one preferred form, the measuring vessel comprises a conical portion extending upwardly therein from the base of the vessel.

Accordingly, in a further aspect, the present invention provides a vessel for measuring the quantity of a dispensed product, the vessel comprising a side wall, an opening defined by the side wall and a base, the vessel comprising a member extending inwards from the base, such that the member reduces the volume of the interior portion of the vessel in the region of the base.

The advantage of providing the vessel with an inwardly extending member from the base is that the member, by reducing the internal volume of the vessel in the region of the base, allows for the easier and more accurate measurement of small amounts of product in the vessel.

The wall of the vessel may have any suitable shape. Cylindrical or frusto-conical is a particularly preferred shape for the wall of the container.

The inwardly extending member may have any suitable shape. In a preferred embodiment, the inwardly extending member is tapered, with the wider portion of the member being towards or adjacent the base of the vessel and the narrow portion of the member being spaced from the base. A particularly suitable form for the inwardly extending member is conical.

In a further aspect, the present invention provides in combination a closure assembly as hereinbefore described and a measuring vessel. The measuring vessel is preferably as hereinbefore described.

In a still further aspect, the present invention provides a closure assembly as hereinbefore described, a container, and a measuring vessel. The measuring vessel is preferably as hereinbefore described.

BRIEF DESCRIPTION OF THE DRAWINGS

Embodiments of the present invention will now be described, by way of example only, having reference to the accompanying drawings, in which.

DETAILED DESCRIPTION

Figure 1:
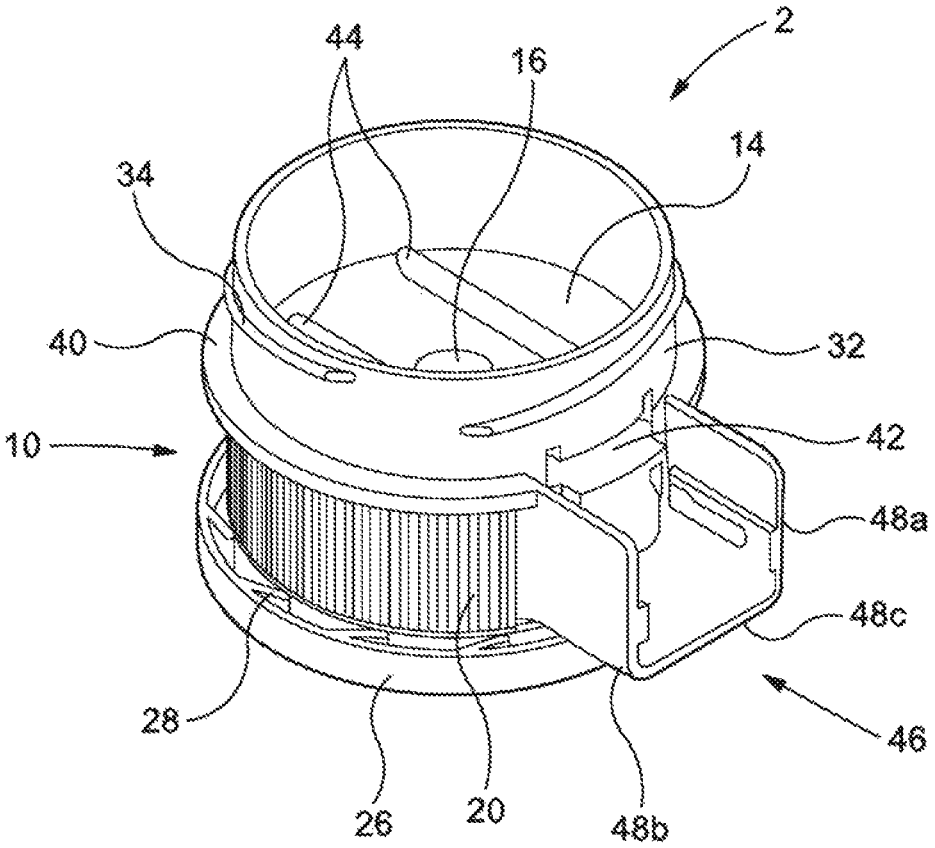
FIG. 1 is a perspective view of a closure assembly of one embodiment of the present invention.
Figure 2:
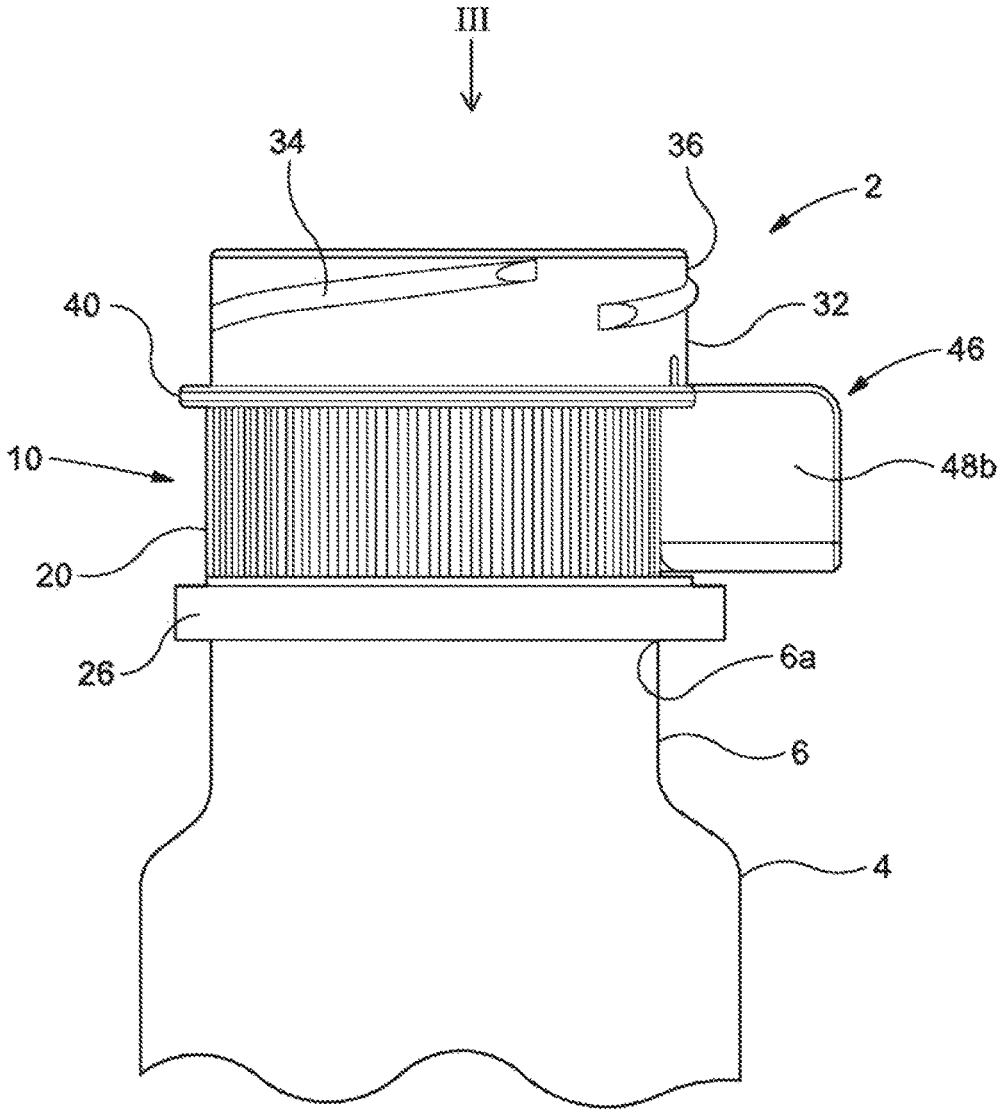
FIG. 2 is a side view of the closure assembly of FIG. 1 on a container.
Figure 3:
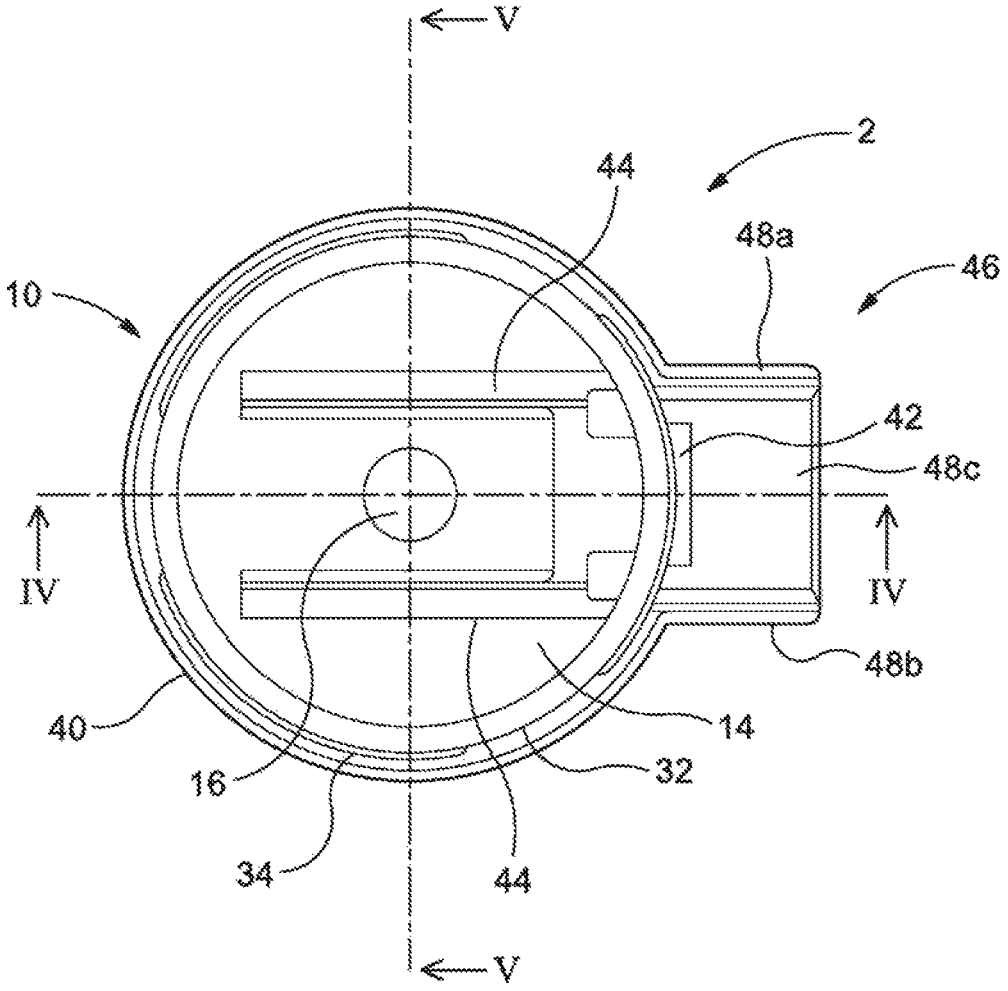
FIG. 3 is a view of the closure assembly of FIG. 2 in the direction of arrow III.
Figure 4:
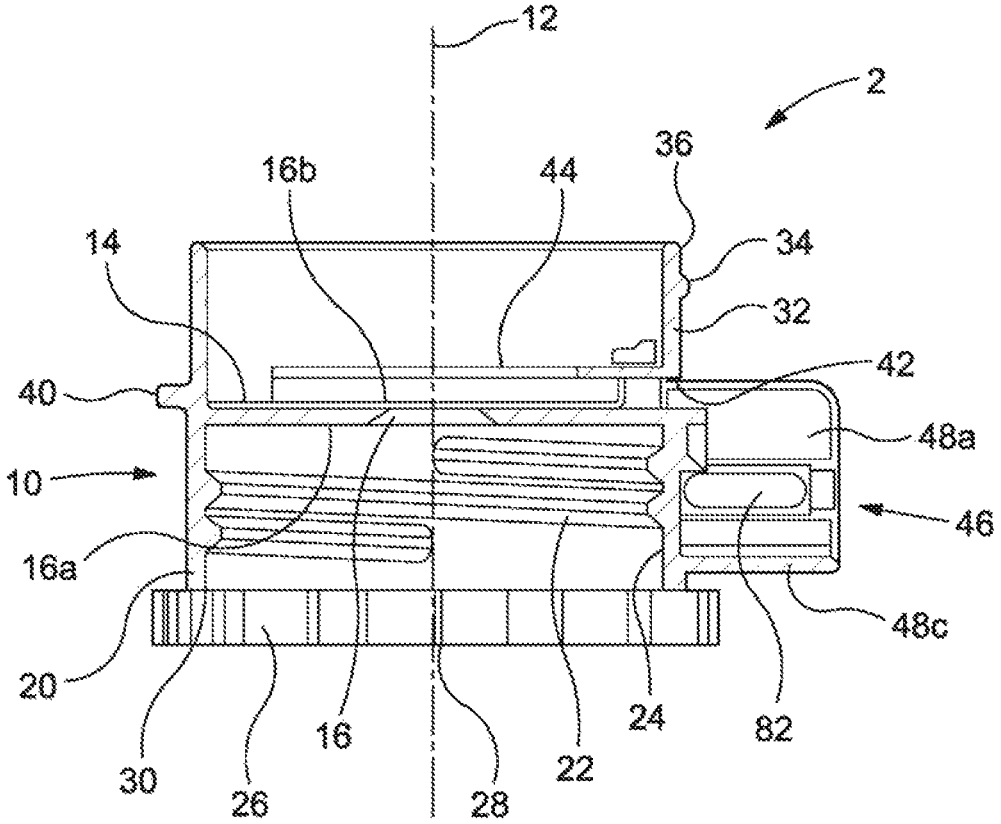
FIG. 4 is a vertical cross-sectional view of the closure assembly of FIG. 3 along the line IV-IV.
Figure 5:
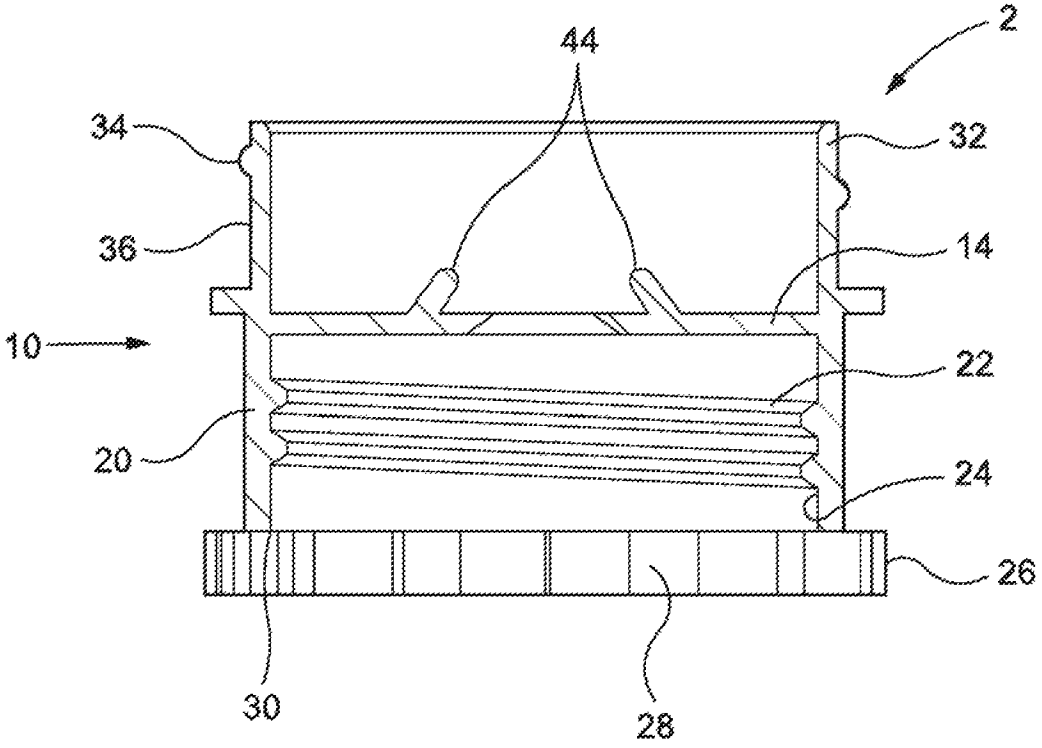
FIG. 5 is a vertical cross-sectional view of the closure assembly along the line V-V of FIG. 3.
Figure 6:
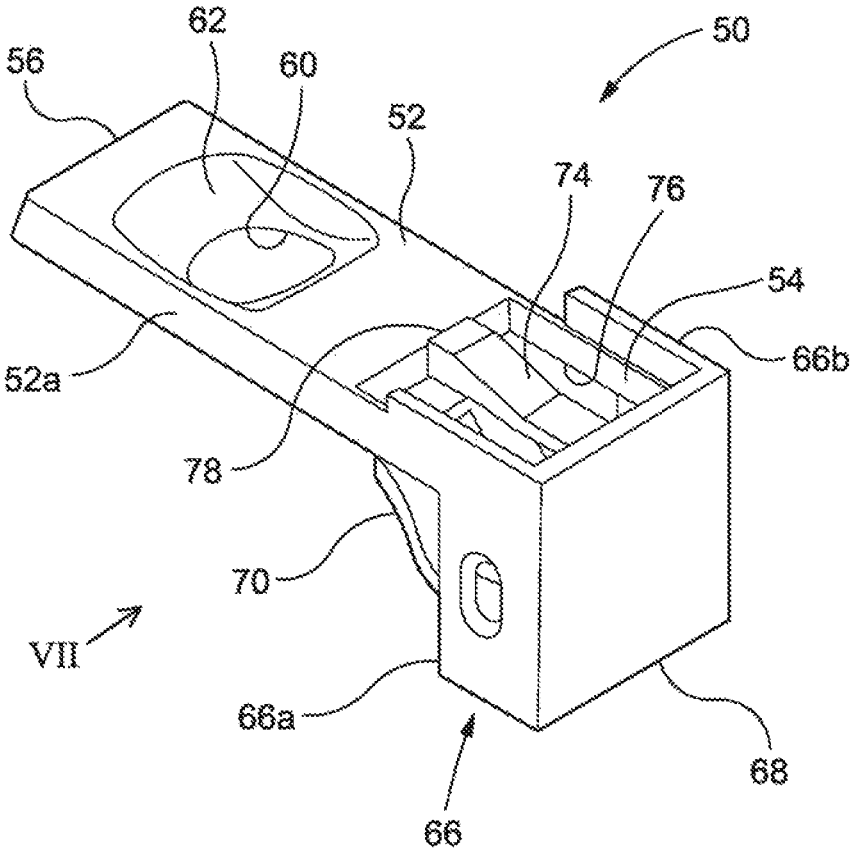
FIG. 6 is a perspective view of a closure member of the closure assembly of FIGS. 1 to 5.
Figure 7:
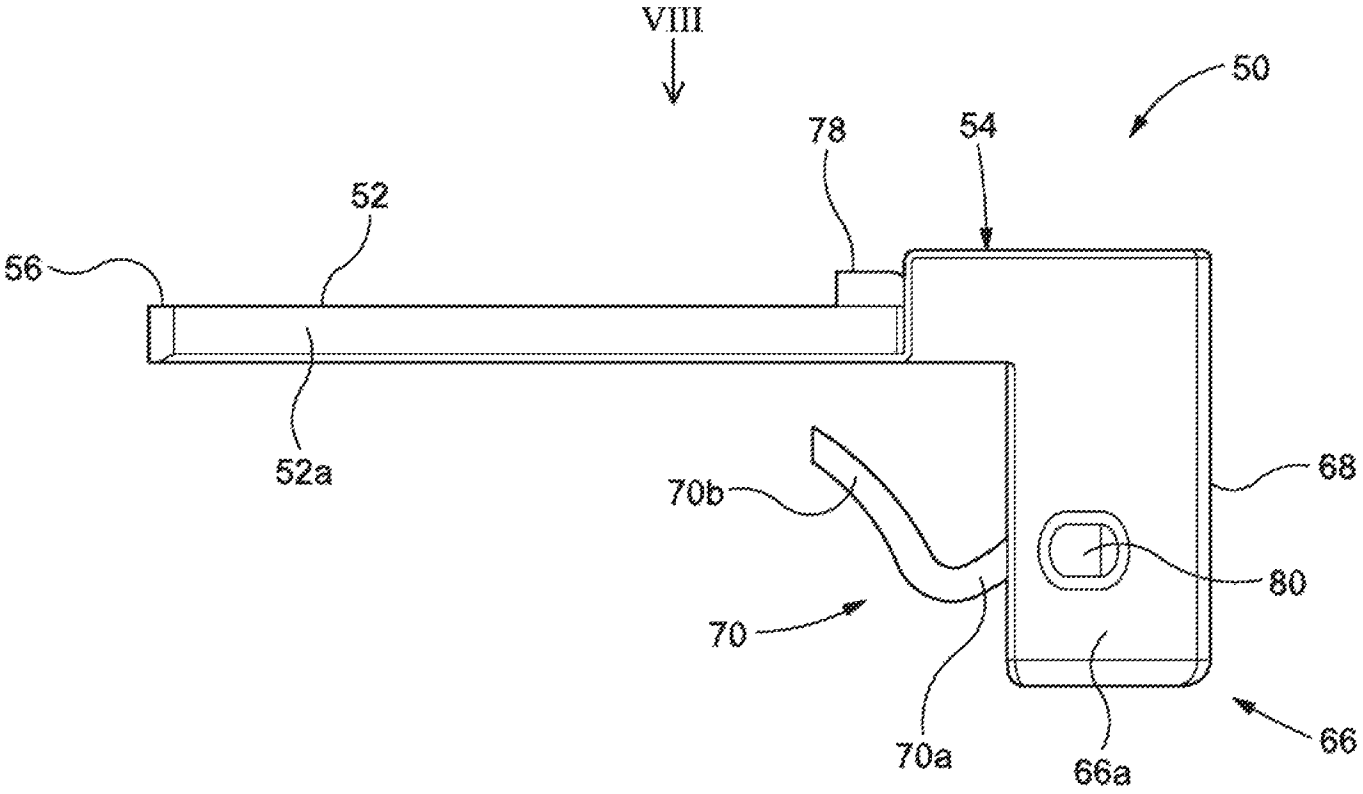
FIG. 7 is a side view of the closure member in the direction of arrow VII of FIG. 6.
Figure 8:
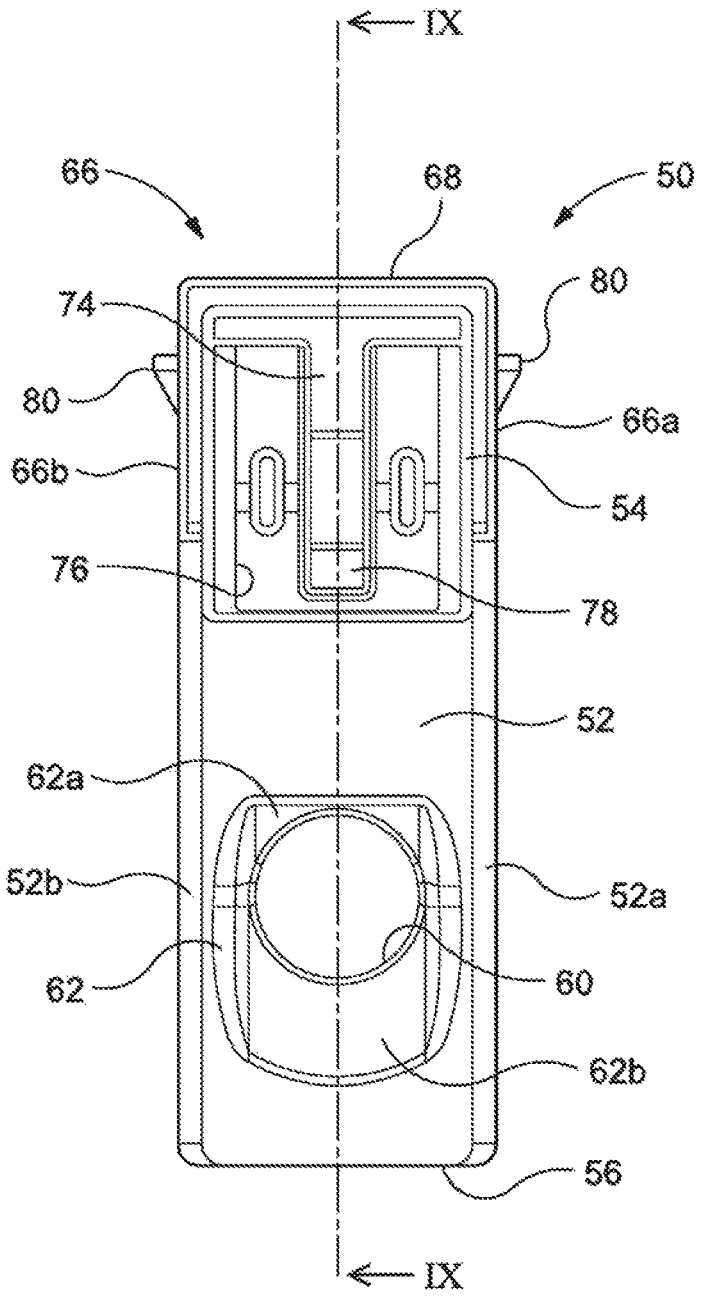
FIG. 8 is a plan view of the closure member in the direction of arrow VIII of FIG. 7.
Figure 9:
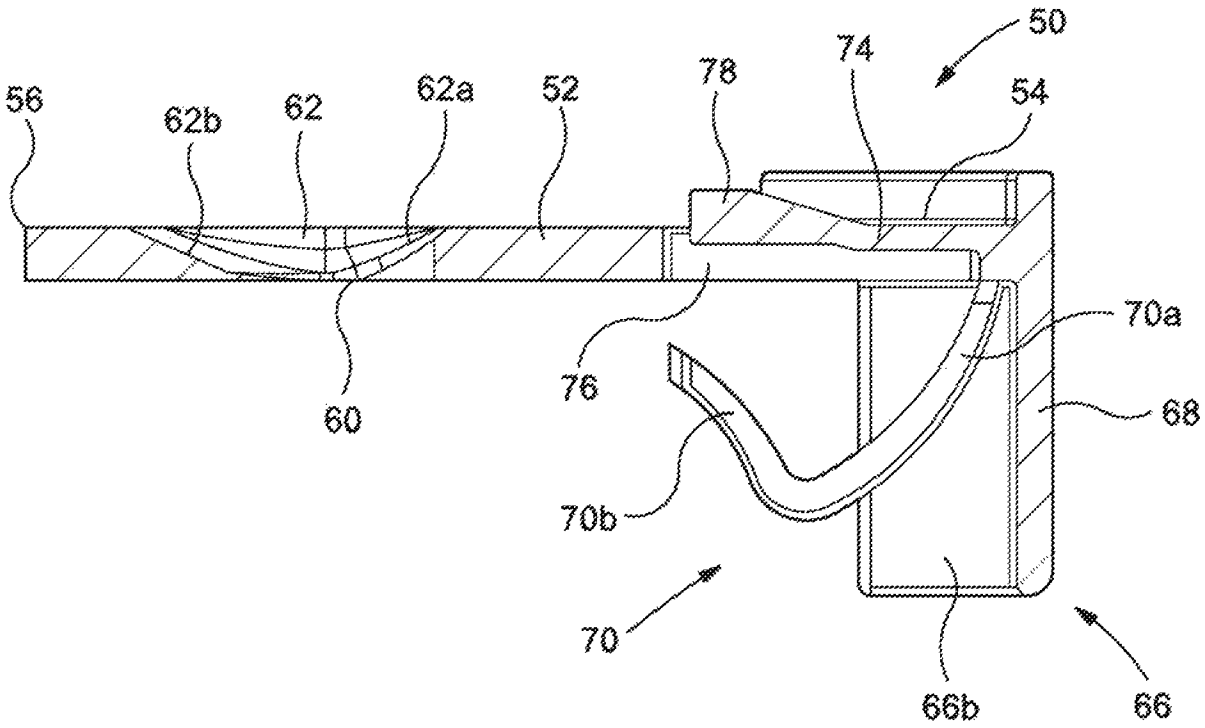
FIG. 9 is a cross-sectional view of the closure member along the line IX-IX of FIG. 7.

Referring to FIG. 1, there is shown a perspective view of one embodiment of a closure assembly of the present invention. A side view of the closure assembly in place on a container is shown in FIG. 2. The closure assembly is shown in vertical cross-section in FIGS. 3 and 5. A horizontal cross-section through the closure assembly is shown in FIG. 4.

It will be appreciated that the closure assembly may be used in many different orientations. Accordingly, the terms 'upper', 'lower', 'above' and 'below' are used in this specification for ease of reference only and refer to the orientation of the assembly as shown in the accompanying figures.

The closure assembly, generally indicated as 2, is shown in FIG. 2 secured to a container 4 of conventional form and having a neck 6 with a circular opening 6*a* therein through which the container may be filled with product and the product dispensed from the container.

The closure assembly 2 has a generally cylindrical closure body 10 having a central longitudinal axis 12. A generally planar closure portion in the form of a circular closure disc 14 extends laterally across the interior of the closure body 10 for extending across the opening 6*a* in the container 4. The closure disc 14 has a bore 16 therethrough. The bore 16 is located centrally in the closure disc 14 and is aligned with the central longitudinal axis 12 of the cylindrical closure body 10. The bore 16 is tapered, with the opening at the lower end 16*a* of the bore, as viewed in the figures, being greater than the opening in the upper end 16*b*.

The portion of the closure body 10 below the closure disc 14 forms a generally tubular first mounting portion 20. The first mounting portion 20 is provided with a thread 22 formed on its inner surface 24. The thread 22 engages with a corresponding thread on the outer surface of the container 4 in the region of the opening 6*a*, in known manner. A collar 26 with barbs 28 formed on its inner surface is provided around the open end 30 of the first mounting portion and prevents inadvertent removal of the closure assembly 2 from the container 4, in known manner.

The portion of the closure body 10 above the closure disc 14 forms a generally tubular second mounting portion 32. The second mounting portion 32 is provided with a thread 34 formed on its outer surface 36. The thread 34 engages with a corresponding thread on the inner surface of a measuring vessel, details of which are provided below. A flange 40 extends circumferentially around the exterior of the closure body 10 and provides a stop to abut the lip of the measuring vessel.

The second mounting portion 32 of the body 10 is provided with a rectangular slot 42 therein, the slot 42 opening above and adjacent the closure disc 14, as shown in FIG. 4. Opposing parallel guide members 44 extend across the closure disc 14 from the slot 42 on either side of the bore 16.

A guard member 46 having walls 48*a*, 48*b* and 48*c* extends outwards from the first mounting portion 20 below the slot 42. A closure member, generally indicated as 50, extends from between the walls of the guard member 46, through the slot 42 and across the upper surface of the closure disc 14. The walls 48*a*, 48*b* and 48*c* of the guard member 46 extend to the side and below an exterior portion of a closure member.

Details of the closure member 50 will now be described with particular reference to FIGS. 6 to 9.

The closure member 50 comprises a rectangular closure plate 52 having a proximal end 54 and a distal end 56. The closure plate 52 has chamfered sides 52*a* and 52*b* for engaging with the guide members 44 on the closure disc 14.

A port 60 extends through the closure plate 52. The port 60 is formed with an eccentric taper 62, such that the cross-sectional area of the port in the upper surface of the closure plate is larger than that in the lower surface. The taper 62 is eccentric in the direction from the proximal end 54 to the distal end 56 and comprises a relatively steep taper portion 62*a* on the proximal side of the port and a relatively shallow taper portion 62*b* on the distal side thereof.

The proximal end 54 of the closure member 50 is provided with an actuator portion 66 connected to the closure plate 52. In use, the user presses on the actuator portion 66 to move the closure member 50 from the closed position to the open position, as described in more detail below. The actuator portion 66 comprises opposing side walls 66*a*, 66*b* and an end wall 68. The actuator portion 66 is accommodated within the guard member 46, with the surface of the end wall 68 exposed. In use, the guard member 46 prevents the closure member 50 being moved inadvertently.

A resilient, V-shaped biasing member 70 having arms 70*a* and 70*b* is connected at the end of one arm 70*a* to the proximal end 54 of the closure plate 52 and extends downwards and inwards within the actuator portion 66. The second arm 70*b* of the biasing member 70 bears against the outer surface of the first mounting portion 20 of the closure body 10. The action of the resilient biasing member 70 is to urge the closure member 50 into the closed position.

A resilient retaining member 74 extends distally of the proximal end 54 within a slot 76 in the proximal end of the closure plate 52. The distal end of the retaining member 74 is provided with a tapered retaining lug 78. In use, with the closure member in the closed position, the retaining member 74 is biased upwards and the end of the retaining lug 78 contacts the outer surface of the second mounting portion 32 just above the slot 42. In this position, the retaining lug 78 prevents the closure member 50 from being moved, in particular moved into the open position. In this way, the closure assembly is held in a closed or shut condition, preventing product from leaving the container.

When the closure assembly is connected to a vessel for receiving dispensed product, such as a measuring vessel, by means of the thread 34 on the outer surface 36 of the second mounting portion 32, the edge of the vessel contacts the retaining lug 78, urging the retaining member 74 downwards, as viewed in the figures, allowing the retaining member 74 to pass through the slot 42, in turn allowing the closure assembly to be moved to the open position. In this way, the container is only opened and product able to be dispensed once the closure assembly has been fully engaged with a vessel, such as a measuring vessel, for receiving the dispensed product.

Lugs 80 are provided on each of the side walls 66*a* and 66*b* of the actuator portion 66 and engage with corresponding slots 82 in each of the side walls 48*a* and 48*b* of the guard member 46.

In use, the closure member 50 is biased into the closed position, with the actuator portion 66 housed within the guard member 46 and the closure plate 52 extending across the upper surface of the closure disc 14. In this position, the port 60 is out of alignment with the bore 16 in the closure disc 14 and the closure plate 52 covers and seals the bore 16 sufficiently to prevent product leaving the container 4. When product is to be dispensed from the container, the user presses on the end wall 68 of the actuator portion 66 of the closure member 50, moving the closure plate 52 in the distal direction across the closure disc 14 against the action of the biasing member 66 and until the port 60 aligns with the bore 16 in the closure disc 14. With the port and bore aligned, product may be dispensed from the container. The user removes the pressure on the end wall 68 of the actuator portion, allowing the closure member 50 to return to the closed position under the action of the resilient biasing member 70, thereby closing the assembly.

Figure 10:
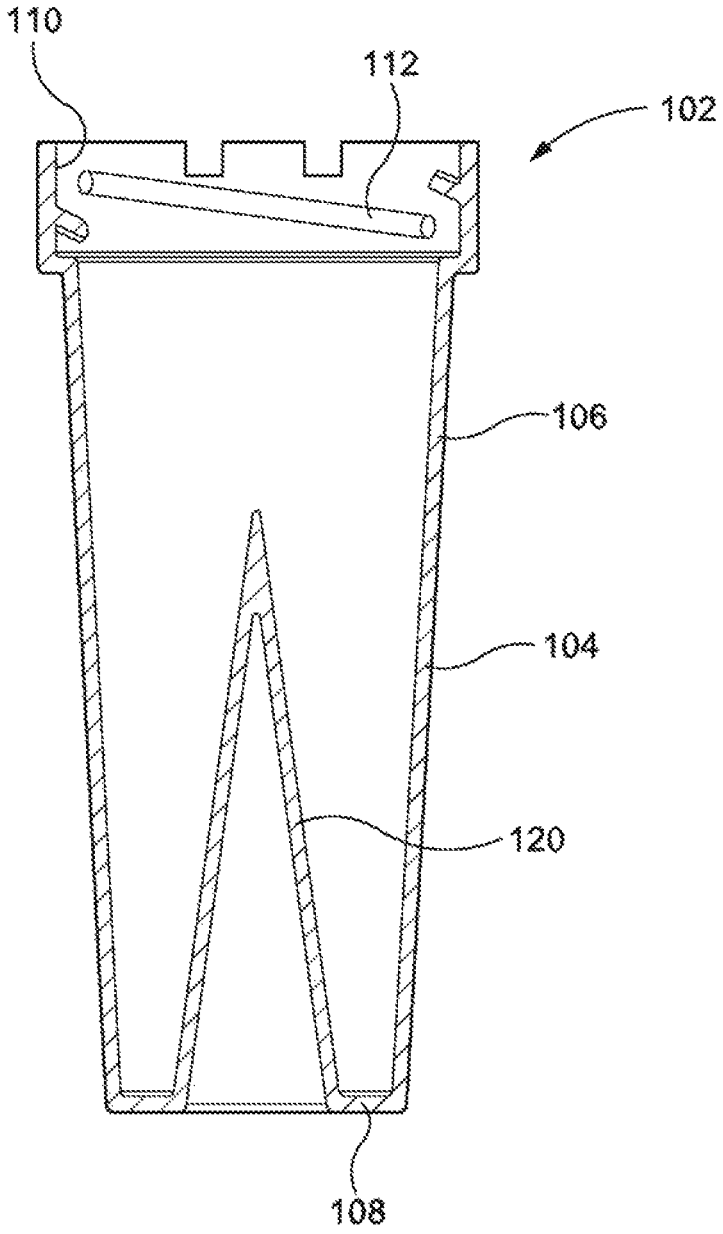
FIG. 10 is a cross-sectional view of a measuring vessel for use with the closure assembly of FIGS. 1 to 9.

A measuring vessel for use with the closure assembly 2 is shown in FIG. 10. The measuring vessel, generally indicated as 102, has an inverted frusto-conical body 104 having a tapered side wall 106 and a base 108. The vessel 102 has an opening 110. The portion of the side wall 106 adjacent the opening 110 is provided with an internal thread 112 corresponding to the thread 34 on the second mounting portion of the closure body 10.

A cone 120 extends upwards within the vessel 102 from the base.

In use, the measuring vessel 102 may be attached to the second mounting portion 32 of the closure assembly 2. In this way, product may be dispensed from the container 4, as described above, directly into the measuring vessel.

The closure assembly, container and the measuring vessel may be used for storing and dispensing a wide range of products, including both liquid and solid products. They have been found to be of particular use for the storage and dispensing of agrochemical products, in particular granular or powdered formulations, for example products containing sulphonyl ureas as active ingredients.

The invention claimed is:

1. A closure assembly for a container, the closure assembly comprising:

a closure body for securing to the container to extend across and seal an opening in the container;

the closure body comprising a bore therein, the bore communicating with the opening in the container and providing a conduit between the interior of the container and the exterior of the container through which product within the container may be dispensed;

a closure member having a port therein, the closure member slideably mounted to the closure body and slideable between a closed position in which the port is out of alignment with the bore in the closure body and the closure member acts to close the bore in the closure member and an open position in which the port is aligned with the bore in the closure body; and wherein the closure member is held in the closed position and is released for movement to the open position when the closure assembly is engaged with a vessel to receive dispensed product.

2. The closure assembly according to claim 1, wherein the closure body is generally cylindrical.

3. The closure assembly according to claim 1, wherein the bore is circular in cross-section.

4. The closure assembly according claim 1, wherein the bore is tapered along its length.

5. The closure assembly according to claim 1, wherein the longitudinal axis of the bore is aligned with a longitudinal axis of the closure body.

6. The closure assembly according to claim 1, wherein the closure body comprises a closure portion for extending across the opening in the container, the bore extending through the closure portion.

7. The closure assembly according to claim 6, wherein the closure portion is a planar body.

8. The closure assembly according to claim 7, wherein the closure portion is a disc.

9. The closure assembly according to claim 1, wherein the closure body comprises a first mounting portion having a thread formed thereon for engaging with a complementary thread on the container in a region of the opening of the container.

10. The closure assembly according to claim 9, wherein the first mounting portion is tubular.

11. A closure assembly for a container, the closure assembly comprising:

a closure body for securing to the container to extend across and seal an opening in the container;

the closure body comprising a bore therein, the bore communicating with the opening in the container and providing a conduit between the interior of the container and the exterior of the container through which product within the container may be dispensed;

a closure member having a port therein, the closure member slideably mounted to the closure body and slideable between a closed position in which the port is out of alignment with the bore in the closure body and the closure member acts to close the bore in the closure member and an open position in which the port is aligned with the bore in the closure body, further comprising a connecting structure for securing the closure body to a vessel to receive product dispensed from the container through the closure assembly when in the open position.

12. The closure assembly according to claim 11, wherein the connecting structure comprises a second mounting portion of the closure body.

13. The closure assembly according to claim 12, wherein the second mounting portion is tubular.

14. The closure assembly according to claim 1, wherein the closure member is slideable laterally across the closure body.

15. The closure assembly according to claim 1, wherein the closure member is arranged to slide across one end of the bore in the closure body.

16. The closure assembly according to claim 15, wherein the closure member is arranged to slide across an outer end of the bore in the closure body.

17. The closure assembly according to claim 1, wherein the port in the closure member is generally circular in at least part of its length.

18. The closure assembly according to claim 1, wherein the closure member is a planar body.

19. The closure assembly according to claim 1, wherein the port in the closure member is tapered along its length.

20. The closure assembly according to claim 19, wherein the widest portion of the port is at an outer end of the port, relative to the interior of the container.

21. The closure assembly according to claim 1, wherein the closure member is moveable through a side wall of the closure body.

22. The closure assembly according to claim 21, wherein an outer end portion of the closure member is enlarged.

23. The closure assembly according to claim 1, further comprising a guard member to limit or prevent inadvertent movement of the closure member.

24. A closure assembly for a container, the closure assembly comprising:

a closure body for securing to the container to extend across and seal an opening in the container;

the closure body comprising a bore therein, the bore communicating with the opening in the container and providing a conduit between the interior of the container and the exterior of the container through which product within the container may be dispensed;

a closure member having a port therein, the closure member slideably mounted to the closure body and slideable between a closed position in which the port is out of alignment with the bore in the closure body and the closure member acts to close the bore in the closure member and an open position in which the port is aligned with the bore in the closure body, a guard member to limit or prevent inadvertent movement of the closure member, wherein the guard comprises one or more guard walls extending from the outer surface of the closure body.

25. The closure assembly according to claim 1, wherein movement of the closure member past the open position is limited by a stop.

26. The closure assembly according to claim 1, wherein the closure member is biased.

27. The closure assembly according to claim 26, wherein the closure member is biased into the closed position.

28. The closure assembly according to claim 27, wherein the closure member is biased by a resilient biasing arm.

29. The closure assembly according to claim 28, wherein the resilient biasing arm acts between the closure body and the closure member.

30. The closure assembly according to claim 29, wherein the resilient biasing arm is connected to the closure member.

31. The closure assembly according claim 1, wherein movement of the closure member is limited to a substantially linear path by guide members.

32. A closure assembly for a container, the closure assembly comprising:

a closure body for securing to the container to extend across and seal an opening in the container;

the closure body comprising a bore therein, the bore communicating with the opening in the container and providing a conduit between the interior of the container and the exterior of the container through which product within the container may be dispensed;

a closure member having a port therein, the closure member slideably mounted to the closure body and slideable between a closed position in which the port is out of alignment with the bore in the closure body and the closure member acts to close the bore in the closure member and an open position in which the port is aligned with the bore in the closure body, wherein the closure member is held in the closed position and is released for movement to the open position when the closure assembly is engaged with a vessel to receive dispensed product.

33. The closure assembly according to claim 32, wherein the closure member is held in the closed position by a retaining member.

34. The closure assembly according to claim 33, wherein the retaining member is moveable between a locked position, in which the closure member is unable to move to the open position, and an unlocked position, in which the closure member is free to move to the open position.

35. The closure assembly according to claim 34, wherein the retaining member is biased to the locked position.

36. The closure assembly according to claim 35, wherein the retaining member is resilient.

37. The closure assembly according to claim 33, wherein the retaining member is connected to the closure member.

38. A vessel for measuring the quantity of a dispensed product, the vessel comprising a side wall, an opening defined by the side wall and a base, the vessel comprising a member extending inwards from the base, such that the member reduces the volume of the interior portion of the vessel in the region of the base, and the vessel being secured to a closure assembly for a container, the closure assembly comprising:

a closure body for securing to the container to extend across and seal an opening in the container;

the closure body comprising a bore therein, the bore communicating with the opening in the container and providing a conduit between the interior of the container and the exterior of the container through which product within the container may be dispensed;

a closure member having a port therein, the closure member slideably mounted to the closure body and slideable between a closed position in which the port is out of alignment with the bore in the closure body and the closure member acts to close the bore in the closure member and an open position in which the port is aligned with the bore in the closure body; and wherein the closure member is held in the closed position and is released for movement to the open position when the closure assembly is engaged with the vessel to receive dispensed product.

39. The vessel according to claim 38, wherein the side wall of the vessel is frusto-conical.

40. The vessel according to claim 38, wherein the member is tapered, with the wider portion of the member being towards or adjacent the base.

41. The vessel according to claim 40, wherein the member is conical.

42. A container comprising a closure assembly as claimed in claim 1.

43. The container according to claim 42, further comprising a measuring vessel.

44. The container according to claim 43, wherein the measuring vessel comprises a side wall, an opening defined by the side wall and a base, a member extending inwards from the base, such that the member reduces the volume of the interior portion of the vessel in the region of the base.

* * * * *